US008407828B2

(12) United States Patent
Vogel et al.

(10) Patent No.: US 8,407,828 B2
(45) Date of Patent: Apr. 2, 2013

(54) FAUCET MOUNTING SYSTEM INCLUDING A LIFT ROD

(75) Inventors: John David Vogel, Columbus, IN (US); Ryan A. Reeder, Carmel, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 1253 days.

(21) Appl. No.: 11/998,700

(22) Filed: Nov. 30, 2007

(65) Prior Publication Data

US 2009/0139024 A1 Jun. 4, 2009

(51) Int. Cl.
*E03C 1/04* (2006.01)

(52) U.S. Cl. ..... 4/678

(58) Field of Classification Search ..... 4/695, 671–678, 4/619, 624, 626
See application file for complete search history.

(56) References Cited

U.S. PATENT DOCUMENTS

| | | | |
|---|---|---|---|
| 166,045 | A | 7/1875 | Weaver |
| 179,003 | A | 6/1876 | Doyle et al. |
| 432,658 | A | 7/1890 | Weaver |
| 439,818 | A | 11/1890 | Hale |
| 447,232 | A | 2/1891 | Croswell |
| 484,423 | A | 10/1892 | Hale |
| 514,214 | A | 2/1894 | Croswell |
| 524,989 | A | 8/1894 | Hale |
| 539,203 | A | 5/1895 | Totham |
| 541,845 | A | 7/1895 | Gilcher |
| 629,628 | A | 7/1899 | Totham |
| 634,347 | A | 10/1899 | Hooper |
| 636,727 | A | 11/1899 | Hinsdale |
| 641,126 | A | 1/1900 | Lewis |
| 645,639 | A | 3/1900 | Bunting, Jr. |
| 654,600 | A | 7/1900 | Bunting, Jr. |
| 667,443 | A | 2/1901 | Jansen |
| 711,238 | A | 10/1902 | Totham |
| 756,663 | A | 4/1904 | Lewis |
| 767,450 | A | 8/1904 | Soderlund |
| 921,230 | A | 5/1909 | Goehle, Sr. |
| 922,253 | A | 5/1909 | Bunting, Jr. |
| 925,245 | A | 6/1909 | Storey |
| 941,797 | A | 11/1909 | Miller |
| 948,033 | A | 2/1910 | Allingham |
| 955,456 | A | 4/1910 | Geurink |
| 1,028,374 | A | 6/1912 | McGuire et al. |
| 1,035,849 | A | 8/1912 | Bergens |
| 1,036,022 | A | 8/1912 | Speakman |

(Continued)

FOREIGN PATENT DOCUMENTS

| | | |
|---|---|---|
| CH | 245633 | 11/1947 |
| CH | 275914 | 6/1951 |

(Continued)

OTHER PUBLICATIONS

Plumb Shop, Model SF0354, Sm Ss Pop Up Clev Clip, at least as early as Aug. 20, 2007, 1 pg.

(Continued)

*Primary Examiner* — Lori Baker
(74) *Attorney, Agent, or Firm* — Faegre Baker Daniels LLP

(57) ABSTRACT

A faucet assembly including a mounting base and an upper faucet assembly. A coupler is pivotally supported by the mounting base and releasably couples the upper faucet assembly to the mounting base. A lift rod is slidably received within a lift rod passageway defined by the coupler.

23 Claims, 14 Drawing Sheets

U.S. PATENT DOCUMENTS

| | | | |
|---|---|---|---|
| 1,048,823 | A | 12/1912 | Graham |
| 1,071,515 | A | 8/1913 | Foster |
| 1,148,456 | A | 7/1915 | Kenney |
| 1,226,879 | A | 5/1917 | Hamm et al. |
| 1,245,943 | A | 11/1917 | Miller |
| 1,254,897 | A | 1/1918 | Frankenberger et al. |
| 1,255,389 | A | 2/1918 | Cornelius |
| 1,258,371 | A | 3/1918 | Speakman |
| 1,333,826 | A | 3/1920 | Yeiser et al. |
| 1,462,853 | A | 7/1923 | Dehn |
| 1,474,986 | A | 11/1923 | Watrous |
| 1,479,944 | A | 1/1924 | Vallier |
| 1,483,850 | A | 2/1924 | Kaufman |
| 1,485,669 | A | 3/1924 | Davis |
| 1,500,416 | A | 7/1924 | Mueller et al. |
| 1,579,564 | A | 4/1926 | Niedecken |
| 1,592,353 | A | 7/1926 | Gade |
| 1,597,459 | A | 8/1926 | Muend |
| 1,607,507 | A | 11/1926 | Blauvelt |
| 1,610,812 | A | 12/1926 | Ottke |
| 1,647,188 | A | 11/1927 | Mueller et al. |
| 1,677,791 | A | 7/1928 | Mueller et al. |
| 1,678,102 | A | 7/1928 | Bresler |
| 1,710,289 | A | 4/1929 | Bresler |
| 1,758,226 | A | 5/1930 | Kaufman |
| 1,766,712 | A | 6/1930 | Johnson |
| 1,848,521 | A | 3/1932 | Fleck |
| 1,859,697 | A | 5/1932 | Fleck |
| 1,918,515 | A | 7/1933 | Beste |
| 1,960,278 | A | 5/1934 | Niedecken |
| 1,965,085 | A | 7/1934 | Rankin |
| 1,980,250 | A | 11/1934 | Baxter |
| 2,063,632 | A | 12/1936 | Schneider |
| 2,091,553 | A | 8/1937 | Mallet |
| 2,137,496 | A | 11/1938 | Klein |
| 2,147,839 | A | 2/1939 | Hagerty |
| 2,173,064 | A | 9/1939 | Judell |
| 2,179,121 | A | 11/1939 | Frank et al. |
| 2,317,898 | A | 4/1943 | Fensch et al. |
| 2,591,991 | A | 4/1952 | Young |
| 2,689,959 | A | 9/1954 | Holycross, Jr. et al. |
| 2,848,721 | A | 8/1956 | Fredrickson |
| 2,768,388 | A | 10/1956 | Smith |
| 2,833,574 | A | 5/1958 | Fife |
| 3,002,196 | A | 10/1961 | Mackey, Jr. |
| 3,010,474 | A | 11/1961 | Moen |
| 3,012,251 | A | 12/1961 | Fife |
| 3,035,276 | A | 5/1962 | Hanson |
| 3,080,570 | A | 3/1963 | Weddendorf, Jr. |
| 3,125,764 | A | 3/1964 | Young |
| 3,155,115 | A | 11/1964 | Ziegler |
| 3,169,254 | A | 2/1965 | Lantz et al. |
| 3,229,710 | A | 1/1966 | Keller, III |
| 3,263,243 | A | 8/1966 | Doyle |
| 3,314,085 | A | 4/1967 | Minella |
| 3,353,192 | A | 11/1967 | Christiansen |
| 3,419,919 | A | 1/1969 | Stayner |
| 3,427,049 | A | 2/1969 | Politz |
| 3,448,768 | A | 6/1969 | Keller, III |
| 3,495,616 | A | 2/1970 | Esposito |
| 3,561,485 | A | 2/1971 | Kingler |
| 3,600,723 | A | 8/1971 | Mongerson et al. |
| 3,609,774 | A | 10/1971 | Allgood |
| 3,645,493 | A | 2/1972 | Manoogian et al. |
| 3,731,326 | A | 5/1973 | Politz |
| 3,763,504 | A | 10/1973 | Parsons |
| 3,790,966 | A | 2/1974 | Keane |
| 3,796,380 | A | 3/1974 | Johnson et al. |
| 3,807,453 | A | 4/1974 | Dom et al. |
| 3,911,946 | A | 10/1975 | Humpert et al. |
| 3,998,240 | A | 12/1976 | Liautaud |
| 4,026,328 | A | 5/1977 | Nelson |
| 4,064,900 | A | 12/1977 | Schmitt |
| 4,186,761 | A | 2/1980 | Guarnieri |
| 4,192,026 | A | 3/1980 | Williams |
| 4,218,785 | A | 8/1980 | Crawford et al. |
| RE30,559 | E | 3/1981 | Schmitt |
| 4,290,445 | A | 9/1981 | Turner |
| 4,328,830 | A | 5/1982 | Greer |
| 4,337,795 | A | 7/1982 | Argyris et al. |
| 4,356,574 | A | 11/1982 | Johnson |
| 4,387,738 | A | 6/1983 | Bisonaya et al. |
| 4,446,885 | A | 5/1984 | Nolden |
| 4,458,839 | A | 7/1984 | MacDonald |
| 4,513,769 | A | 4/1985 | Purcell |
| 4,552,171 | A | 11/1985 | Farrell et al. |
| 4,577,349 | A | 3/1986 | Clegg |
| 4,635,673 | A | 1/1987 | Gerdes |
| 4,649,958 | A | 3/1987 | Purcell |
| 4,671,316 | A | 6/1987 | Botnick |
| 4,678,002 | A | 7/1987 | Valley |
| 4,698,858 | A | 10/1987 | Kostorz |
| 4,700,928 | A | 10/1987 | Marty |
| 4,706,702 | A | 11/1987 | Grasseschi |
| 4,760,861 | A | 8/1988 | Botnick |
| 4,762,143 | A | 8/1988 | Botnick |
| 4,762,273 | A | 8/1988 | Gregory et al. |
| 4,771,485 | A | 9/1988 | Traylor |
| 4,827,538 | A | 5/1989 | Heimann et al. |
| 4,848,395 | A | 7/1989 | Krippendorf |
| 4,852,192 | A | 8/1989 | Viegener |
| 4,856,121 | A | 8/1989 | Traylor |
| 4,903,725 | A | 2/1990 | Ko |
| 4,903,943 | A | 2/1990 | Hochstrasser |
| 4,911,335 | A | 3/1990 | Stofle et al. |
| 4,966,186 | A | 10/1990 | Rodstein |
| 4,998,555 | A | 3/1991 | Barhydt, Sr. et al. |
| 5,010,922 | A | 4/1991 | Agresta |
| 5,020,569 | A | 6/1991 | Agresta |
| 5,022,429 | A | 6/1991 | Rollini et al. |
| 5,027,851 | A | 7/1991 | Drees et al. |
| 5,073,991 | A | 12/1991 | Marty |
| 5,090,062 | A | 2/1992 | Hochstrasser |
| 5,095,554 | A | 3/1992 | Gloor |
| 5,127,427 | A | 7/1992 | Kajpust et al. |
| 5,127,438 | A | 7/1992 | Williams |
| 5,131,428 | A | 7/1992 | Bory |
| 5,148,832 | A | 9/1992 | Lin |
| 5,165,121 | A | 11/1992 | McTargett et al. |
| 5,232,008 | A | 8/1993 | Jeffress et al. |
| 5,275,199 | A | 1/1994 | Howell |
| 5,349,987 | A | 9/1994 | Shieh |
| 5,361,431 | A | 11/1994 | Freier et al. |
| 5,375,272 | A | 12/1994 | Mikol |
| 5,388,287 | A | 2/1995 | Tischler et al. |
| 5,465,749 | A | 11/1995 | Sauter et al. |
| 5,467,799 | A | 11/1995 | Buccicone et al. |
| 5,509,150 | A | 4/1996 | Bergmann et al. |
| 5,515,882 | A | 5/1996 | Hennis |
| 5,518,016 | A | 5/1996 | Sharwark |
| 5,535,776 | A | 7/1996 | Kingman |
| 5,558,128 | A | 9/1996 | Pawelzik et al. |
| 5,566,707 | A | 10/1996 | Ching et al. |
| 5,640,724 | A | 6/1997 | Holmes |
| 5,642,755 | A | 7/1997 | Mark et al. |
| 5,660,203 | A | 8/1997 | Gnauert et al. |
| 5,669,417 | A | 9/1997 | Lain-Jie |
| 5,685,341 | A | 11/1997 | Chrysler et al. |
| 5,687,952 | A | 11/1997 | Arnold et al. |
| 5,725,008 | A | 3/1998 | Johnson |
| 5,746,244 | A | 5/1998 | Woolley, Sr. et al. |
| 5,758,688 | A | 6/1998 | Hamanaka et al. |
| 5,787,521 | A | 8/1998 | O'Connell et al. |
| 5,797,151 | A | 8/1998 | Ko |
| 5,803,120 | A | 9/1998 | Bertoli |
| 5,813,431 | A | 9/1998 | Cool et al. |
| 5,819,337 | A | 10/1998 | Bergmann |
| 5,822,811 | A | 10/1998 | Ko |
| 5,822,812 | A | 10/1998 | Worthington et al. |
| 5,845,345 | A | 12/1998 | Ko |
| 5,865,211 | A | 2/1999 | Thomas |
| 5,865,473 | A | 2/1999 | Semchuck et al. |
| 5,884,662 | A | 3/1999 | Ko |
| 5,894,613 | A | 4/1999 | Fenn |
| 5,918,855 | A | 7/1999 | Hamanaka et al. |
| 5,924,451 | A | 7/1999 | Kuo |
| 5,946,746 | A | 9/1999 | Bloom |

| | | | |
|---|---|---|---|
| 5,950,663 | A | 9/1999 | Bloomfield |
| 5,960,490 | A | 10/1999 | Pitsch |
| 5,979,489 | A | 11/1999 | Pitsch |
| 5,983,917 | A | 11/1999 | Thomas |
| 5,996,143 | A | 12/1999 | Lordahl et al. |
| 6,006,784 | A | 12/1999 | Tsutsui et al. |
| 6,014,985 | A | 1/2000 | Warshawsky |
| 6,023,795 | A | 2/2000 | Pötter et al. |
| 6,023,796 | A | 2/2000 | Pitsch |
| 6,061,847 | A | 5/2000 | Jourdan |
| 6,062,251 | A | 5/2000 | Pitsch |
| 6,073,972 | A | 6/2000 | Rivera |
| 6,082,407 | A | 7/2000 | Paterson et al. |
| 6,085,784 | A | 7/2000 | Bloom et al. |
| 6,123,106 | A | 9/2000 | Benstead |
| 6,125,875 | A | 10/2000 | Dempsey et al. |
| 6,138,296 | A | 10/2000 | Baker |
| 6,161,230 | A | 12/2000 | Pitsch |
| 6,170,098 | B1 | 1/2001 | Pitsch |
| 6,189,569 | B1 | 2/2001 | Calhoun |
| 6,195,818 | B1 | 3/2001 | Rodstein et al. |
| 6,202,686 | B1 | 3/2001 | Pitsch et al. |
| 6,202,980 | B1 | 3/2001 | Vincent et al. |
| 6,209,153 | B1 | 4/2001 | Segien, Jr. |
| 6,220,278 | B1 | 4/2001 | Sauter et al. |
| 6,220,279 | B1 | 4/2001 | Segien |
| 6,256,810 | B1 | 7/2001 | Baker |
| 6,267,136 | B1 | 7/2001 | Johnson |
| 6,273,138 | B1 | 8/2001 | Yoney |
| 6,273,394 | B1 | 8/2001 | Vincent et al. |
| 6,301,728 | B1 | 10/2001 | Pilatowicz et al. |
| 6,302,131 | B1 | 10/2001 | Pitsch |
| 6,308,351 | B1 | 10/2001 | Franke |
| 6,314,593 | B1 | 11/2001 | Mantel |
| 6,328,059 | B1 | 12/2001 | Testori et al. |
| 6,334,226 | B1 | 1/2002 | Tokunaga et al. |
| 6,360,770 | B1 | 3/2002 | Buchner et al. |
| 6,360,774 | B1 | 3/2002 | Becker et al. |
| 6,367,102 | B1 | 4/2002 | McMullen et al. |
| 6,370,712 | B1 | 4/2002 | Burns et al. |
| 6,378,912 | B1 | 4/2002 | Condon et al. |
| 6,385,798 | B1 | 5/2002 | Burns et al. |
| 6,405,749 | B1 | 6/2002 | Bloom et al. |
| 6,421,849 | B1 | 7/2002 | Gray |
| 6,422,520 | B1 | 7/2002 | Hand |
| 6,434,765 | B1 | 8/2002 | Burns et al. |
| 6,438,771 | B1 | 8/2002 | Donath, Jr. et al. |
| 6,457,191 | B2 | 10/2002 | Brandebusemeyer et al. |
| 6,484,330 | B2 | 11/2002 | Gray et al. |
| 6,491,058 | B1 | 12/2002 | Wang |
| 6,571,407 | B1 | 6/2003 | Skarie |
| 6,619,320 | B2 | 9/2003 | Parsons |
| 6,631,730 | B1 | 10/2003 | Bloom et al. |
| 6,684,906 | B2 | 2/2004 | Burns et al. |
| 6,718,568 | B1 | 4/2004 | Hensley |
| 6,725,472 | B2 | 4/2004 | Gray et al. |
| 6,757,921 | B2 | 7/2004 | Esche |
| 6,792,629 | B2 | 9/2004 | Nelson et al. |
| 6,807,692 | B2 | 10/2004 | Tsutsui et al. |
| 6,868,564 | B2 | 3/2005 | Ginter et al. |
| 6,874,527 | B2 | 4/2005 | Meeder |
| 6,874,535 | B2 | 4/2005 | Parsons et al. |
| 6,904,623 | B2 | 6/2005 | Ohta et al. |
| 6,912,742 | B1 | 7/2005 | Wang |
| 6,918,400 | B2 | 7/2005 | Buchner et al. |
| 6,973,685 | B2 | 12/2005 | Duncan |
| 7,017,600 | B2 | 3/2006 | Klein |
| 7,055,545 | B2 | 6/2006 | Mascari et al. |
| 7,175,158 | B2 | 2/2007 | Thomas |
| 7,698,755 | B2 * | 4/2010 | McNerney et al. ..... 4/695 |
| 2001/0011389 | A1 | 8/2001 | Philipps-Liebich et al. |
| 2001/0044955 | A1 | 11/2001 | Brandebusemeyer |
| 2001/0052150 | A1 | 12/2001 | Onoue |
| 2002/0083520 | A1 | 7/2002 | Osborne-Kirby |
| 2002/0124309 | A1 | 9/2002 | Donath, Jr. et al. |
| 2002/0185182 | A1 | 12/2002 | Wang |
| 2002/0189674 | A1 | 12/2002 | Meeder |
| 2003/0041374 | A1 | 3/2003 | Franke |
| 2003/0204906 | A1 | 11/2003 | Tsutsui et al. |
| 2003/0221254 | A1 | 12/2003 | McNemey et al. |
| 2004/0034924 | A1 | 2/2004 | Underbrink et al. |
| 2004/0060109 | A1 | 4/2004 | Hensley |
| 2004/0094202 | A1 | 5/2004 | Kawolics et al. |
| 2004/0123910 | A1 | 7/2004 | Yardley |
| 2004/0143900 | A1 | 7/2004 | Nelson et al. |
| 2004/0154673 | A1 | 8/2004 | Mascari et al. |
| 2004/0179351 | A1 | 9/2004 | Patterson |
| 2004/0200987 | A1 | 10/2004 | Houghton |
| 2004/0221899 | A1 | 11/2004 | Parsons et al. |
| 2005/0022299 | A1 | 2/2005 | Brown et al. |
| 2005/0066440 | A1 | 3/2005 | Fischl |
| 2005/0199843 | A1 | 9/2005 | Jost et al. |
| 2005/0242198 | A1 | 11/2005 | Kempf et al. |
| 2005/0242199 | A1 | 11/2005 | Kempf et al. |
| 2005/0251907 | A1 | 11/2005 | Mintz et al. |
| 2006/0042006 | A1 | 3/2006 | Thomas |
| 2006/0076056 | A1 | 4/2006 | Schmitt et al. |
| 2006/0080773 | A1 | 4/2006 | McNerney et al. |
| 2006/0179564 | A1 | 8/2006 | Jacobs |
| 2006/0200904 | A1 | 9/2006 | Vogel et al. |
| 2007/0044232 | A1 | 3/2007 | McNerney et al. |
| 2007/0271695 | A1 | 11/2007 | Thomas et al. |
| 2008/0023085 | A1 | 1/2008 | Rosko et al. |

FOREIGN PATENT DOCUMENTS

| | | |
|---|---|---|
| CN | 1278584 | 1/2001 |
| CN | 1278585 | 1/2001 |
| CN | 1278586 | 1/2001 |
| CN | 1278588 | 1/2001 |
| CN | 1639427 | 7/2005 |
| DE | 100 22 350 A1 | 11/2001 |
| EP | 0 808 952 B1 | 9/2003 |
| GB | 371616 | 5/1931 |
| WO | WO 03/066977 | 8/2003 |
| WO | WO 2005/056937 | 6/2005 |
| WO | WO 2005/118966 | 12/2005 |

OTHER PUBLICATIONS

BrassCraft, Model PS2344, Lava Pop-Up Ctr Piece Assembly, at least as early as Aug. 20, 2007, 1 pg.

Drawing of known lift rod coupling, at least as early as Aug. 20, 2007, 1 pg.

* cited by examiner

FAUCET MOUNTING SYSTEM INCLUDING A LIFT ROD

BACKGROUND AND SUMMARY OF THE INVENTION

The present invention relates generally to faucets and, more particularly, to a mounting system for a faucet.

The installation of a faucet onto a mounting deck is often a difficult and time-consuming task. At least some of the installation may require the installer to work in the cramped and dimly lit work area under the sink or mounting deck. More particularly, faucets are typically attached to the mounting deck with threaded connections which must be made under and behind the sink basin wherein there is very little room to work.

As such, there is a need to provide a less cumbersome and complicated system of installing faucets or interchanging different faucet styles onto a mounting deck which can be done largely from the top of the countertop or sink. More particularly, a system is desired which would permit the installer to exchange different escutcheon styles, delivery spouts, and/or handle combinations quickly and easily without replacing the complete faucet assembly.

When interchanging different style faucets onto a mounting deck, the corresponding lift rods often have different geometries or orientations. For instance, single handle faucets often include a lift rod having a rearwardly angled lift rod, while dual handle faucets often include a substantially vertically aligned lift rod. As such, it is further desired to have a system which would permit the installer to exchange different faucet styles having different lift rod orientations.

According to an illustrative embodiment of the present disclosure, a faucet assembly includes a delivery spout, and at least one valve fluidly coupled to the delivery spout and configured to control the flow of water to the delivery spout. A lift rod is supported for movement relative to the delivery spout. A tubular guide includes a lift rod passageway slidably receiving the lift rod and defining a longitudinal axis. The guide is supported for pivoting movement about a transverse axis extending perpendicular to the longitudinal axis.

According to another illustrative embodiment of the present disclosure, a faucet assembly includes a mounting base configured to be coupled to a mounting deck. An upper faucet assembly is positioned above the mounting base and includes a delivery spout and a locking surface. A coupler includes a support member pivotally supported by the mounting base, and a securing member connected to the support member and releasably engaging the locking surface of the upper faucet assembly for releasably securing the upper faucet assembly to the mounting base.

According to yet another illustrative embodiment of the present disclosure, a coupling system is provided for use with a faucet assembly including a lift rod. The coupling system includes a mounting base configured to be coupled to a mounting deck. A coupler includes a support member and a securing member movably connected to the support member. The support member defines a lift rod passageway configured to slidably receive a lift rod and defining a longitudinal axis. The support member is supported by the mounting base for pivoting movement about a transverse axis extending perpendicular to the longitudinal axis.

According to a further illustrative embodiment of the present disclosure, a faucet system includes a mounting base configured to be coupled to a mounting deck and supporting a lift rod passageway. A first upper faucet assembly includes a delivery spout, and a single handle coupled to a control valve to control the flow of water to the delivery spout. A second upper faucet assembly includes a delivery spout, a first handle coupled to a first control valve to control the flow of hot water to the delivery spout, and a second handle coupled to a second control valve to control the flow of cold water to the delivery spout. A lift rod includes a longitudinal axis and is slidably received within the lift rod passageway. The first upper faucet assembly and the second upper faucet assembly are configured to be interchangeably mounted on the mounting base with the lift rod extending through the lift rod passageway. The longitudinal axis of the lift rod has a first angular orientation when the first upper faucet assembly is mounted on the mounting base and has a second angular orientation when the second upper faucet assembly is mounted on the mounting base. The first angular orientation is different from the second angular orientation.

According to another illustrative embodiment of the present disclosure, a method of mounting a faucet assembly includes the steps of coupling a mounting base to a mounting deck, the mounting base including a lift rod passageway. The method further includes the steps of coupling a first upper faucet assembly to the mounting base, the first upper faucet assembly including a lift rod received within the lift rod passageway at a first angular orientation within a plane extending perpendicular to the mounting deck. The method further includes the steps of uncoupling the first upper faucet assembly from the mounting base, and coupling a second upper faucet assembly to the mounting base, the second upper faucet assembly including a lift rod received within the lift rod passageway at a second angular orientation within the plane extending perpendicular to the mounting deck. The second angular orientation is different from the first angular orientation.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiment selected for description have been chosen to enable one skilled in the art to practice the invention.

Figure 1:
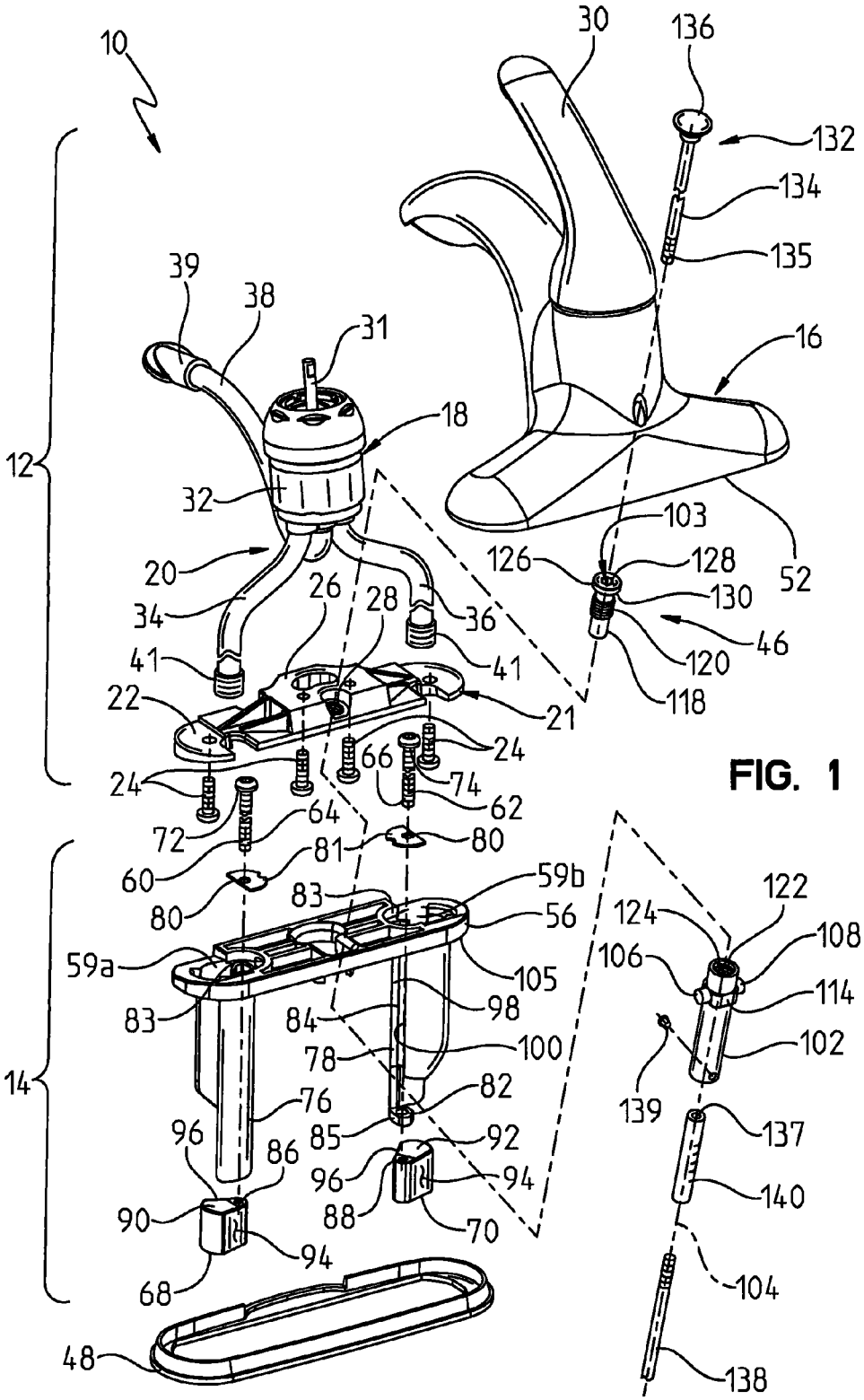
FIG. 1 is an exploded perspective view of an illustrative embodiment single handle faucet assembly.
Figure 2:
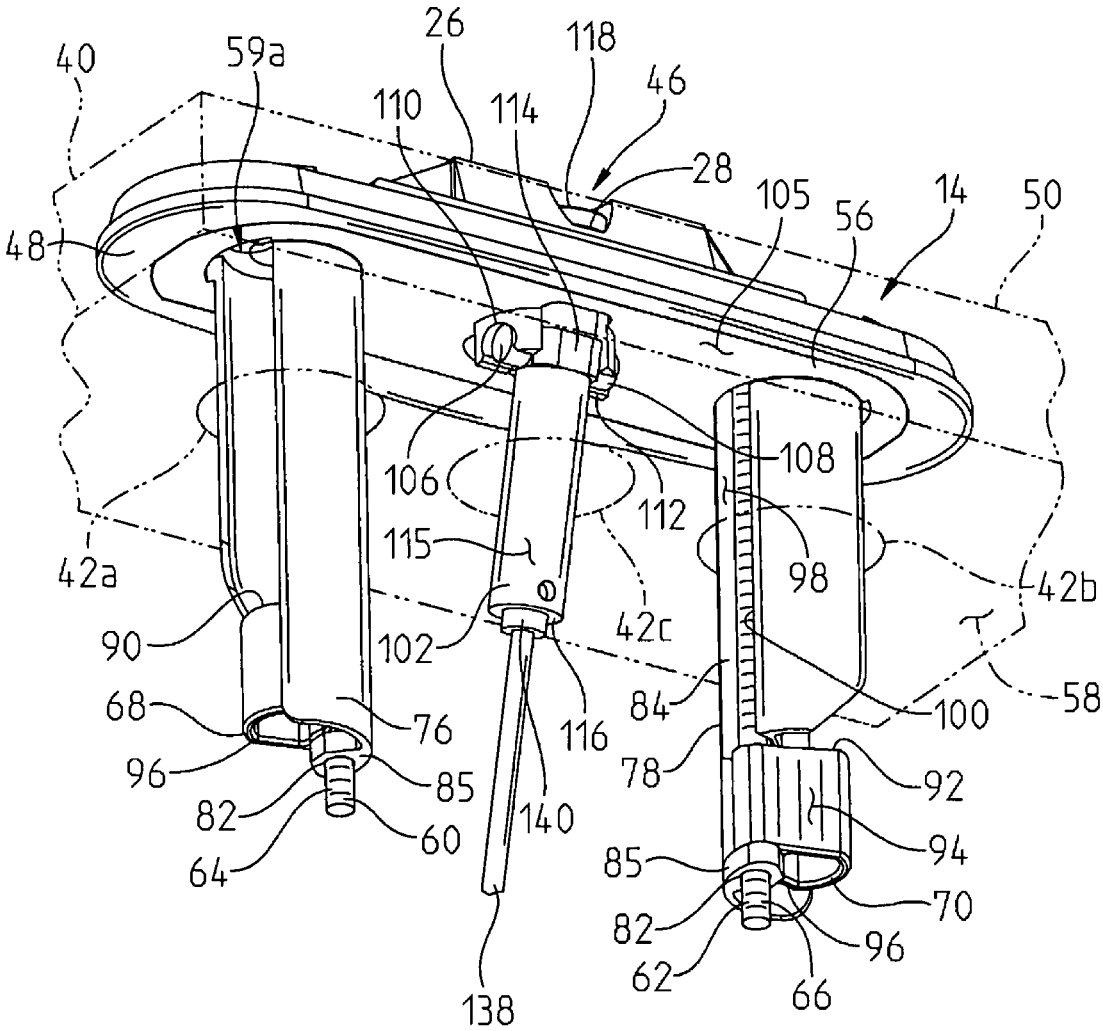
FIG. 2 is a partial bottom perspective view of the mounting base of FIG. 1, positioned on a mounting deck.
Figure 3:
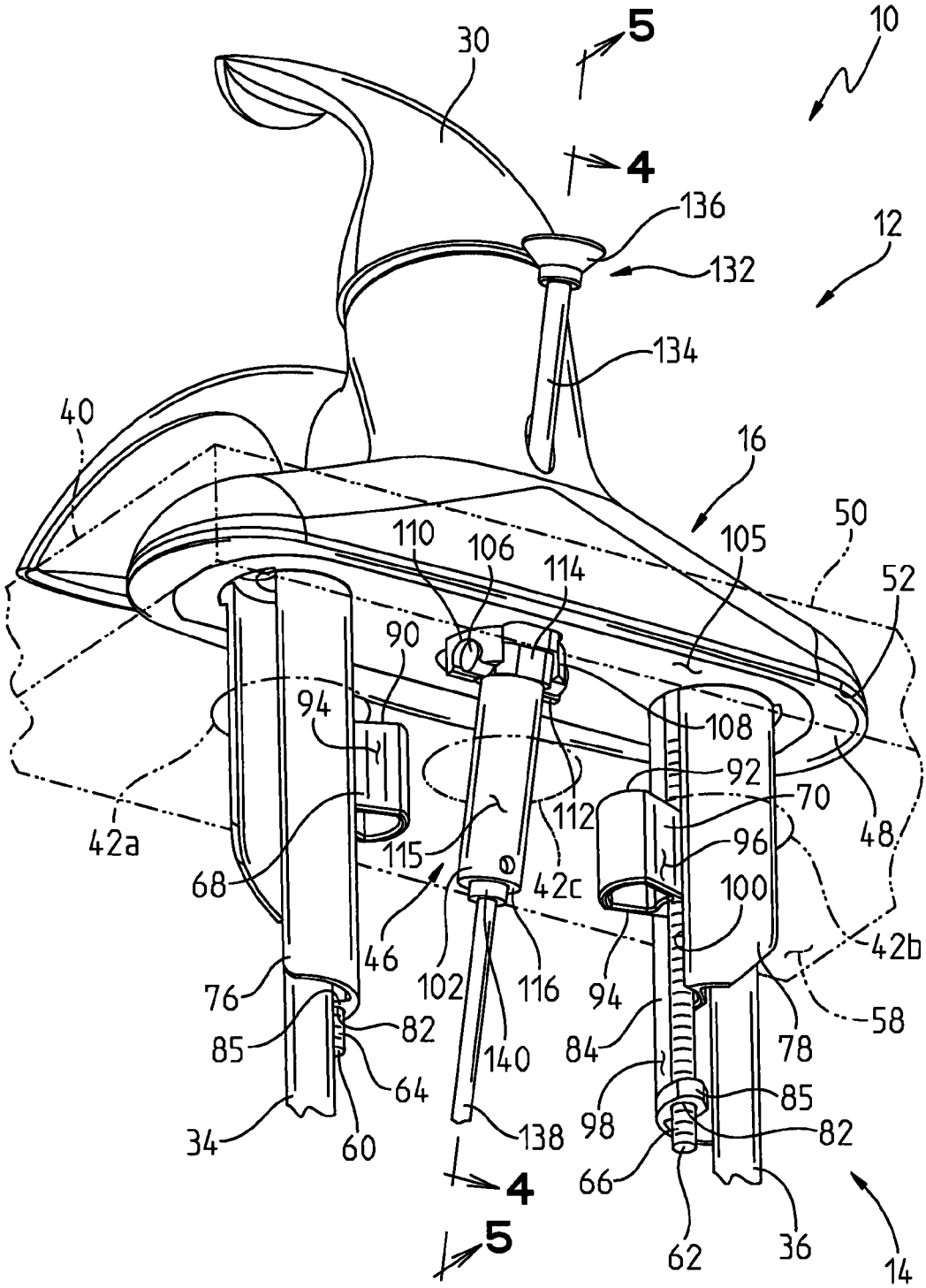
FIG. 3 is a bottom perspective view similar to FIG. 2, showing locking members coupling the faucet assembly to the mounting deck.

Referring initially to FIGS. 1-3, an illustrative embodiment single handle faucet assembly 10 is shown as including an upper faucet assembly 12 positioned above a mounting base 14. The upper faucet assembly 12 illustratively includes an escutcheon or body housing 16 receiving a mixing valve 18 fluidly coupled to a waterway assembly 20. A lower securing member or support 21 is secured to a lower portion of the escutcheon 16 below the mixing valve 18. The lower securing member 21 includes a base 22 which receives fasteners 24, such as bolts, to couple to the escutcheon 16. An attachment block 26 defining a locking or engagement surface 28 is supported by the base 22.

With further reference to FIG. 1, a handle 30 is coupled to a stem 31 of the mixing valve 18 in a conventional manner, for example, through the use of a set screw (not shown). The valve 18 illustratively includes an outer housing 32 which receives a valving member, such as a ball or disk assembly (not shown) of conventional design, for controlling the flow of water passing through the valve 18 in response to operation of the handle 30. More particularly, the valve 18 controls the rate and relative proportion of water flowing from cold and hot water inlet conduits 34 and 36 of the waterway assembly 20 to an outlet water conduit, illustratively a delivery spout 38. An overmolded coupler 39 illustratively retains the delivery spout 38 to the escutcheon 16. A conventional aerator (not shown) may be coupled to an end of the delivery spout 38 for discharging water therefrom. The valve 18 may be of conventional design, and illustratively of the type disclosed in U.S. patent application Ser. No. 11/494,889, filed Jul. 28, 2006, entitled "MIXING VALVE". Similarly, the waterway assembly 20 may be of conventional design, and illustratively of the type disclosed in U.S. patent application Ser. No. 11/700,634, filed Jan. 31, 2007, entitled "FAUCET INCLUDING A MOLDED WATERWAY ASSEMBLY".

Each of the inlet water conduits 34 and 36 illustratively includes an end connector 41 configured to couple to a fluid coupling for supplying water from hot and cold water sources (not shown). The fluid couplings may comprise a quick release coupling, such as PMC Series couplings available from Colder Products Company of St. Paul, Minn. Other conventional fluid couplings may be substituted therefor, such as those detailed in U.S. Pat. No. 6,672,628.

Illustratively, the inlet water conduits 34 and 36 are formed of a flexible material to facilitate positioning of the respective end connectors 41 relative to the faucet assembly 10. In one illustrative embodiment, the inlet water conduits 34 and 36 and outlet conduit 38 are all formed of cross-linked polyethylene (PEX).

With reference to FIGS. 2 and 3, the mounting base 14 is supported by a mounting deck 40, typically a countertop or sink deck having access openings 42*a*, 42*b*, 42*c*. As detailed herein, a coupler or guide 46 releasably couples the upper faucet assembly 12 to the mounting base 14. A resilient gasket 48 is illustratively received intermediate an upper surface 50 of the mounting deck 40 and a lower surface 52 of the escutcheon 16.

The mounting base 14 illustratively includes a mounting plate 56 which is mounted from the top of the mounting deck 40 and rests on the upper surface 50 thereof. It should be noted that the mounting base 14 may also be mounted from the underside of the mounting deck 40 below its lower surface 58. Access openings 59*a* and 59*b* are formed within the mounting plate 56 and are configured to receive the inlet conduits 34 and 36.

First and second attachment posts 60 and 62 extend downwardly from the mounting plate 56. The attachment posts 60 and 62 each include a plurality of external threads 64 and 66 and are configured to operably couple with first and second mounting base locking members 68 and 70, respectively. An upper end of each post 60 and 62 extends through the mounting plate 56 and includes a head 72 and 74 configured to be manipulated by a tool, such as a screwdriver or Allen wrench (not shown). Arcuate supports 76 and 78 extend substantially parallel to the attachment posts 60 and 62, respectively. Upper and lower apertures 80 and 82 receive each attachment post 60 and 62, respectively. Each upper aperture 80 is illustratively formed within an insert 81 supported within a recess 83 formed within the mounting plate 56. Each lower aperture 82 is illustratively formed within a bracket 85 coupled to a lower end of the respective support 76, 78. Further, each support 76 and 78 includes a groove 84 which is configured to receive the respective attachment post 60 and 62 and guide the respective locking member 68 and 70 in movement longitudinally therealong. In one illustrative embodiment, the mounting plate 56 and the supports 76 and 78 are integrally formed, for example, through molding of a thermoplastic material.

The mounting plate locking members 68 and 70 each include a threaded opening 86 and 88 configured to threadably engage the respective attachment post 60 and 62. Each locking member 68 and 70 is substantially wedge shaped and includes an upper surface 90 and 92 configured to cooperate with the mounting plate 56 to clamp the mounting base 14 to the deck 40. When the mounting plate 56 is positioned on the mounting deck 40, the threaded attachment posts 60 and 62 are rotated to cause the mounting plate locking members 68 and 70 to move longitudinally up and down on the posts 60 and 62, respectively. Illustratively, counterclockwise rotation of attachment posts 60 and 62 causes locking members 68 and 70 to move downwardly or away from mounting deck 40 to an unlocked position. Clockwise rotation of attachment posts 60 and 62 causes locking members 68 and 70 to move upwardly or toward mounting deck 40 to a locked position. In the locked position, the upper surfaces 90 and 92 of the locking members 68 and 70 abuts the bottom or lower surface 58 of mounting deck 40, thereby securing the mounting plate 56 thereto.

The locking members 68 and 70 are prevented from rotating with the attachment posts 60 and 62 as they are turned, by guide surfaces 94 and 96 of each locking member 68 and 70, respectively. The guide surfaces 94 and 96 abut against cooperating stop surfaces 98 and 100 of the grooves 84 defined within the supports 76 and 78, upon rotation of the locking members 68 and 70, respectively. This causes locking members 68 and 70 to ride up or down the attachment posts 60 and 62 within the grooves 84 as they are rotated instead of rotating 360 degrees with the rotation of the posts 60 and 62. As noted above, attachment posts 60 and 62 are stabilized and secured at their bottom portions by brackets 85.

As noted above, a gasket 48 is illustratively received around the periphery of the mounting base 14 and is supported by the upper surface 50 of the mounting deck 40. The gasket 48 is configured to fill the gap between a lower surface 52 of the escutcheon 16 and the upper surface 50 of the mounting deck 40. Illustratively, the gasket 48 is formed from a resilient elastomer.

With reference to FIGS. 1-5A, the coupler or guide 46 illustratively includes a tubular support or collar 102 having a lift rod passageway 103 defining a longitudinal axis 104 and pivotally supported by the lower surface 105 of the mounting plate 56. More particularly, the support 102 includes a pair of diametrically opposed pivot pins 106 and 108 received within downwardly extending sockets 110 and 112 supported by the lower surface 105 of the mounting plate 56. In an embodiment, one or more pivot pins may be rotatably received by one or more sockets. A flange 114, illustratively a nut, extends outwardly from an outer surface 115 the cylindrical side wall 116 of the support 102.

A securing member 118, illustratively, a lock bushing, is coupled to the support 102 and is configured to move along the longitudinal axis 104 relative to the support 102. Illustratively, the lock bushing 118 includes external threads 120 which are configured to threadably engage internal threads 122 formed within an inner surface 124 of the cylindrical side wall 116 of the support 102. An upper end of the lock bushing 118 includes an annular flange 126. A tool engaging member 128, illustratively a plurality of surfaces configured to receive a tool, such as an Allen or hex socket wrench 129 (FIG. 5B), is formed within the upper end of the lock bushing 118. Rotation of the wrench 129 is thereby transferred to the lock bushing 118.

Figure 4:
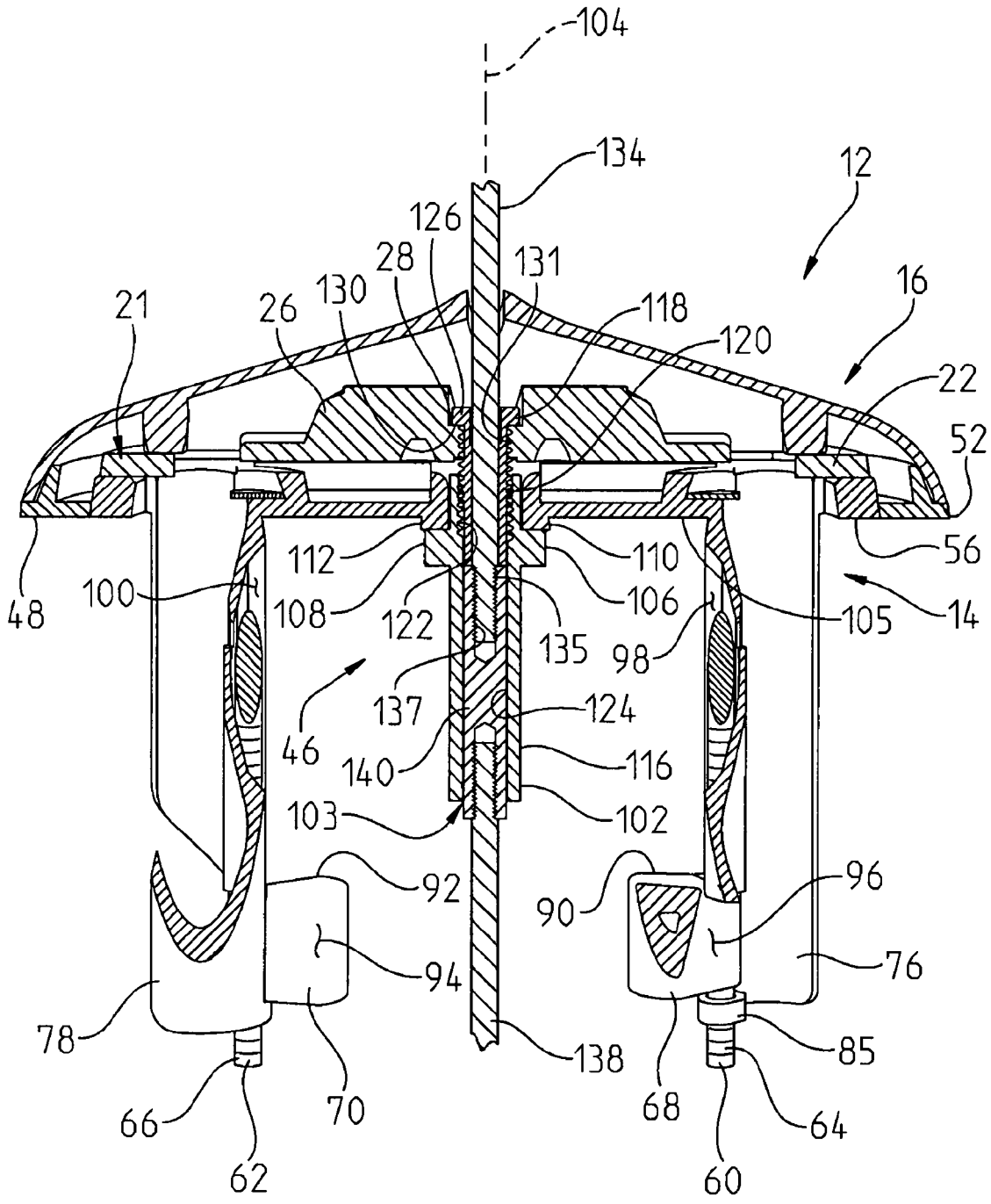
FIG. 4 is a cross-sectional view taken along line 4-4 of FIG. 3, with the mixing valve and waterway assembly removed for clarity.
Figure 5A:
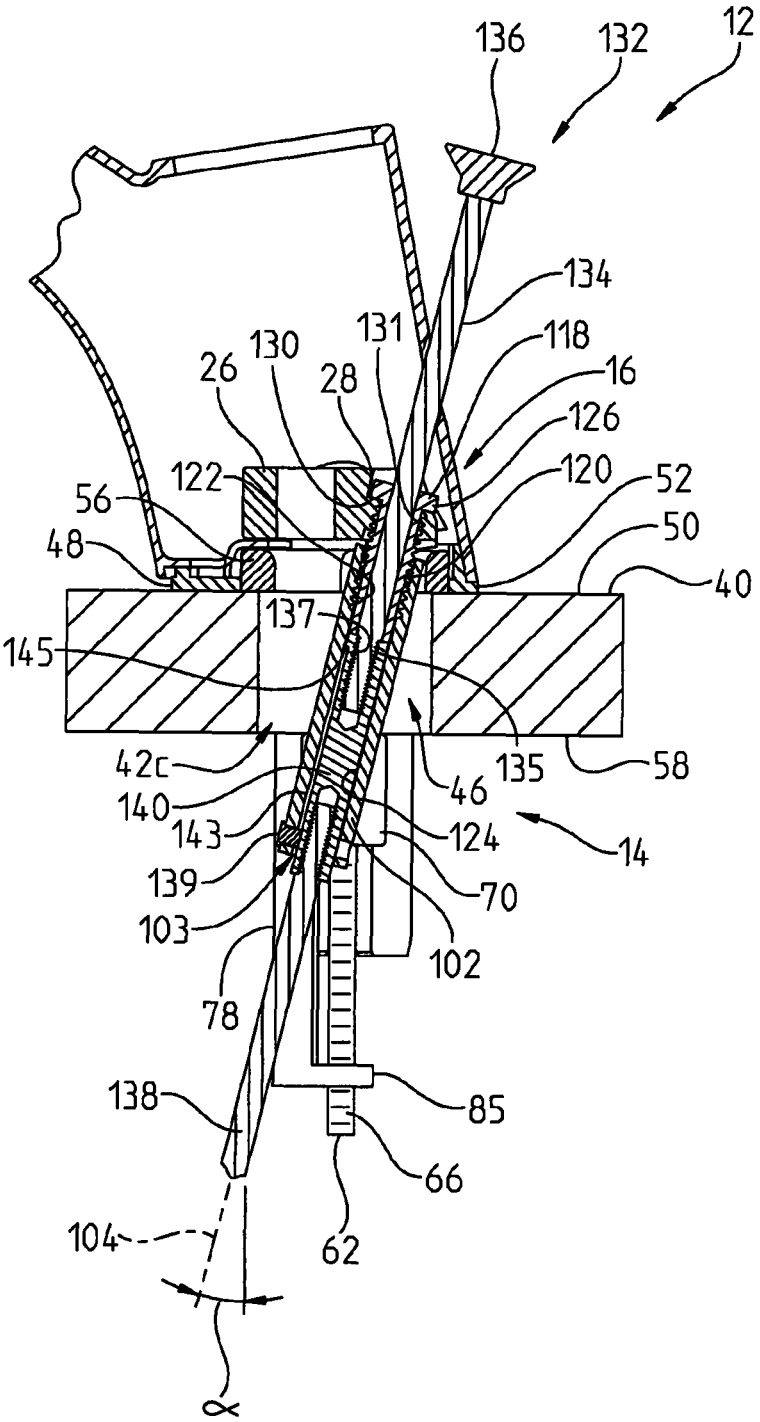
FIG. 5A is a cross-sectional view taken along line 5-5 of FIG. 3, with the mixing valve and waterway assembly removed for clarity.
Figure 5B:
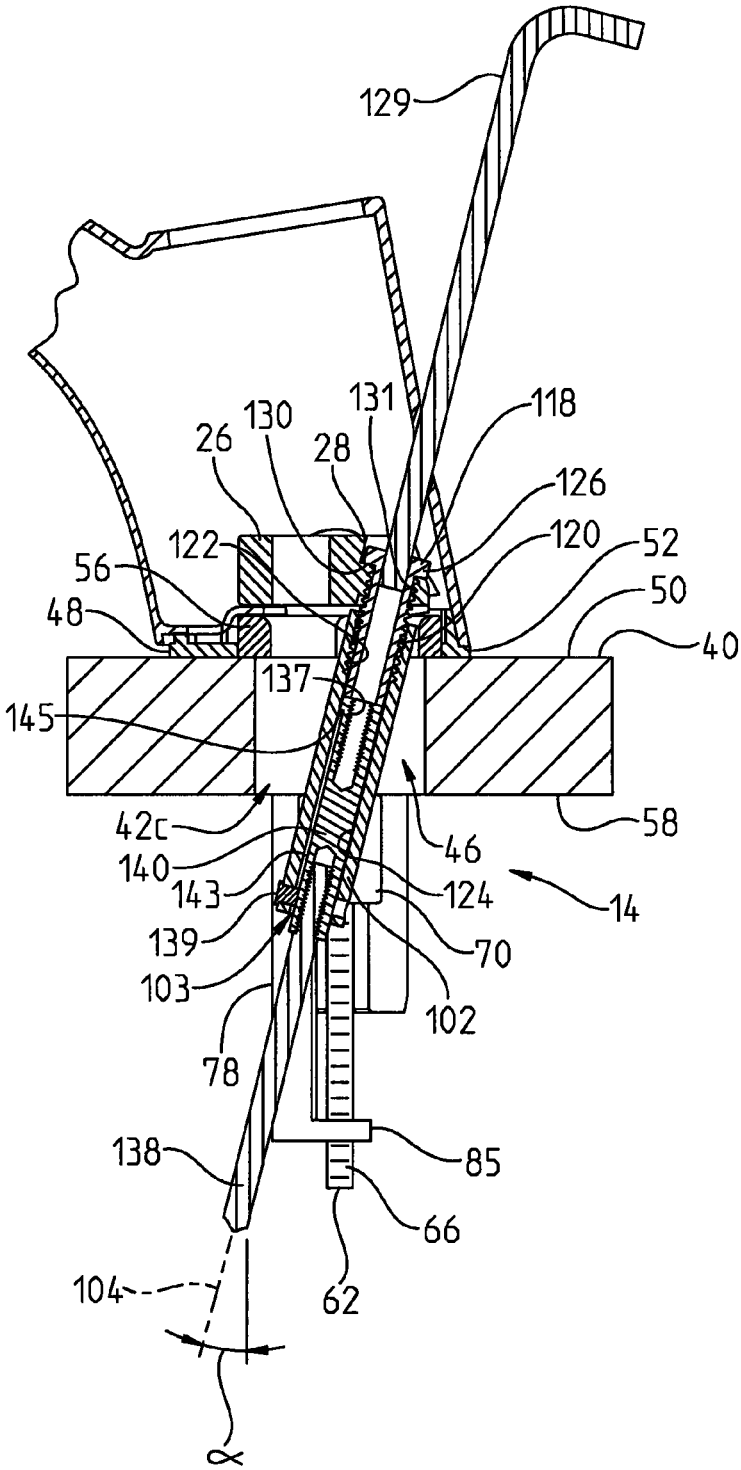
FIG. 5B is a cross-sectional view similar to FIG. 5A, with the upper member of the lift rod removed and replaced with a tool.

With reference to FIGS. 1, 4, and 5B, rotation of the lock bushing 118 within the support or collar 102 causes the lock bushing 118 to move up or down relative thereto. As the lock bushing 118 is moved upwardly, the flange 126 of the upper end moves away from the engagement surface 28 of the upper faucet assembly 12. As the lock bushing 118 is moved downwardly, a lower surface 130 of the flange 126 engages the locking surface 28 of the lower securing member 21, thereby clamping the upper faucet assembly 12 between the lock bushing 118 and the support 102. In one illustrative embodiment, the threads 120 of the lock bushing 118 may threadably engage threads 131 of the lower securing member 21.

With reference now to FIG. 5A, a lift rod 132 is illustratively slidably received within the lift rod passageway 103 defined by the coupler 46. The lift rod 132 includes an upper member 134 supporting a handle 136. A lower member 138 is connected to the upper member 134 through a lift rod coupler 140. More particularly, an upper end of the lower member 138 and a lower end of the upper member 134 are coupled to opposing lower and upper ends of the coupler 140, respectively. The lower member 138 and the upper member 134 may be fixed to the coupler 140 through conventional means, such as friction fits, threads, adhesives, etc. In the illustrative embodiment, shown in FIGS. 1, 4, and 5A, the upper member 134 is releasably coupled to the coupler 140. More particularly, the lower end of the upper member 134 includes a plurality of external threads 135 configured to engage a plurality of internal threads 137 formed within the upper end of the coupler 140.

Figure 6:
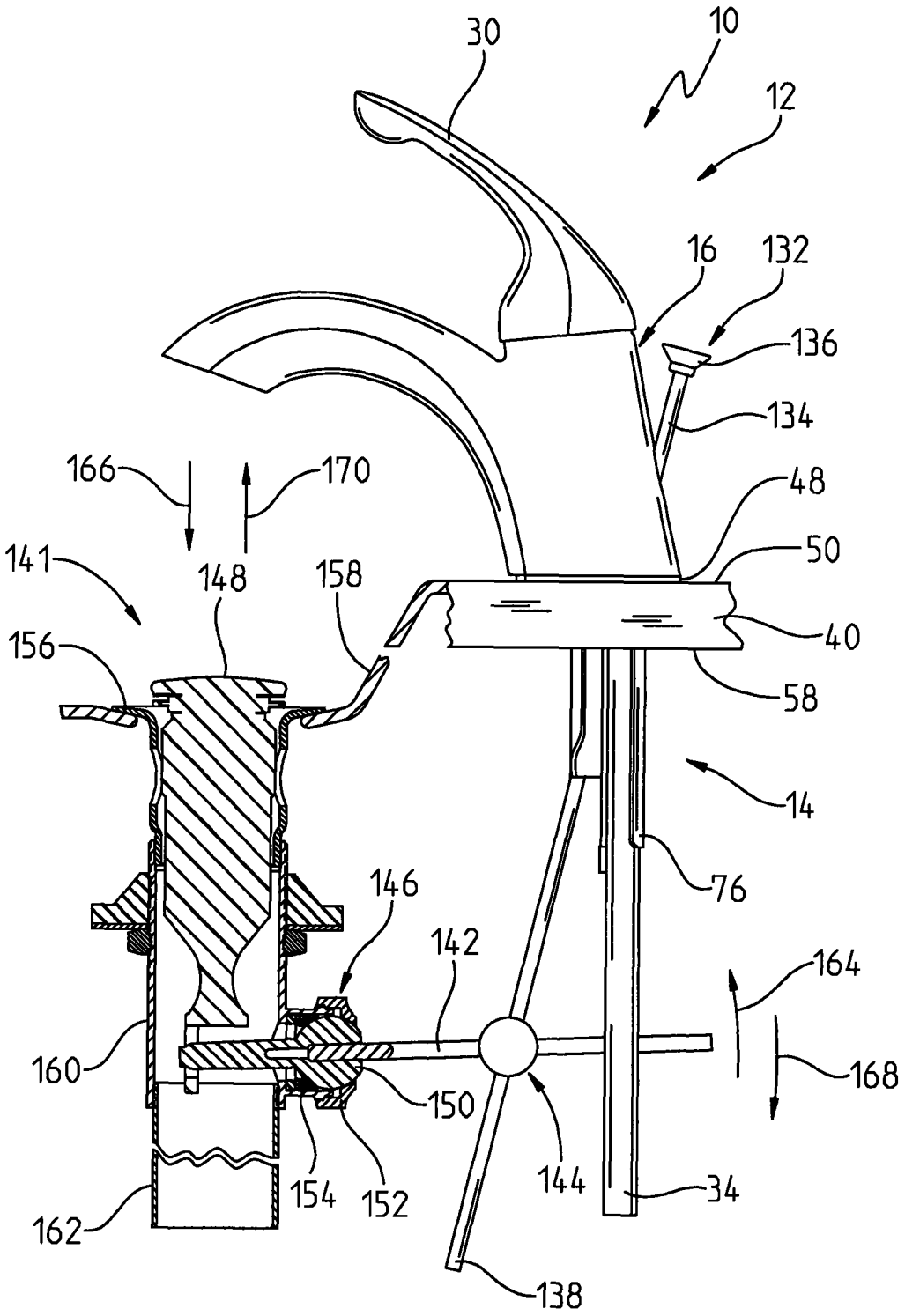
FIG. 6 is a side elevational view, in partial cross-section, illustrating the faucet assembly of FIG. 1 coupled to a pop-up drain assembly.
Figure 7:
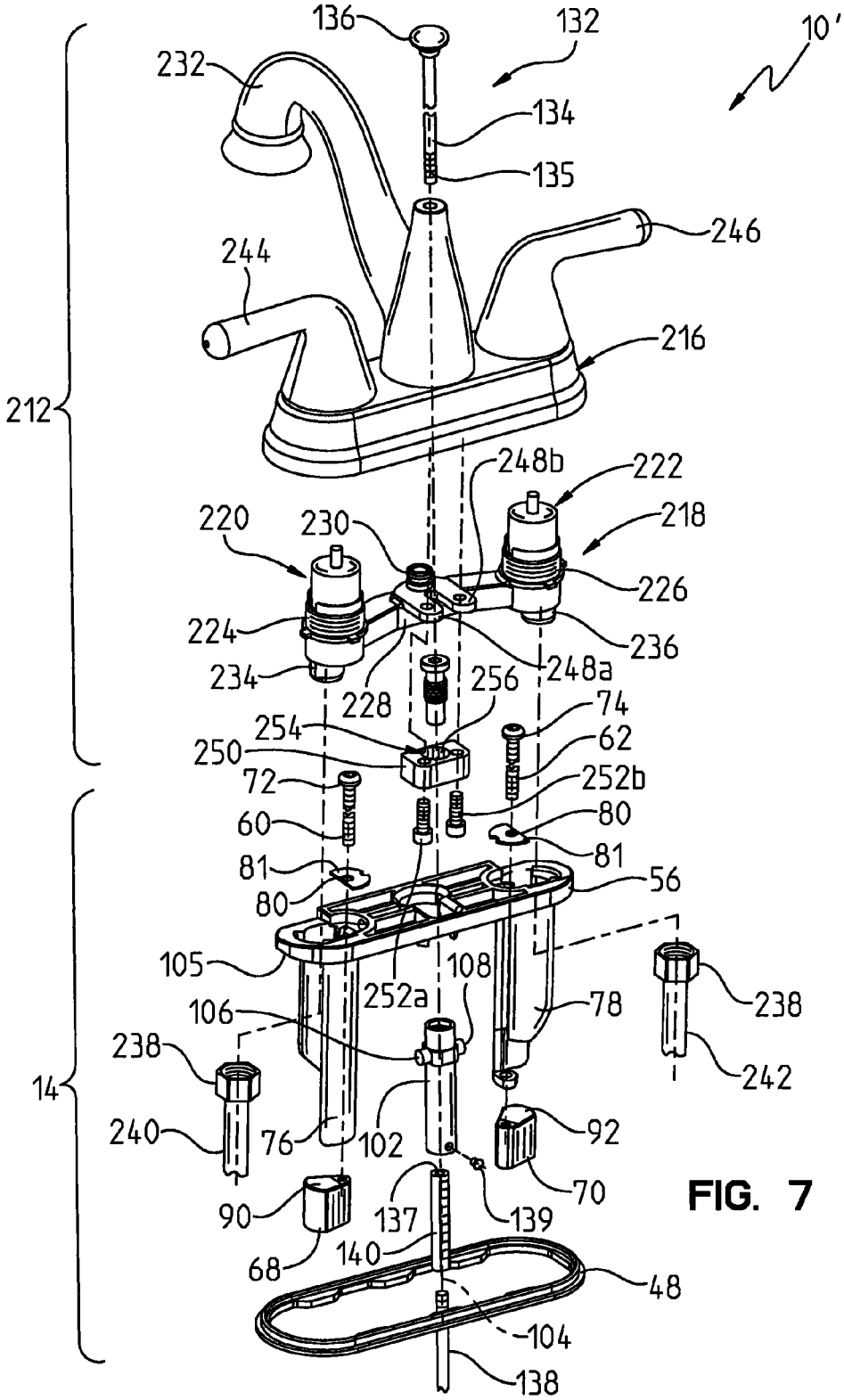
FIG. 7 is an exploded perspective view of an illustrative embodiment dual handle faucet assembly.
Figure 8:
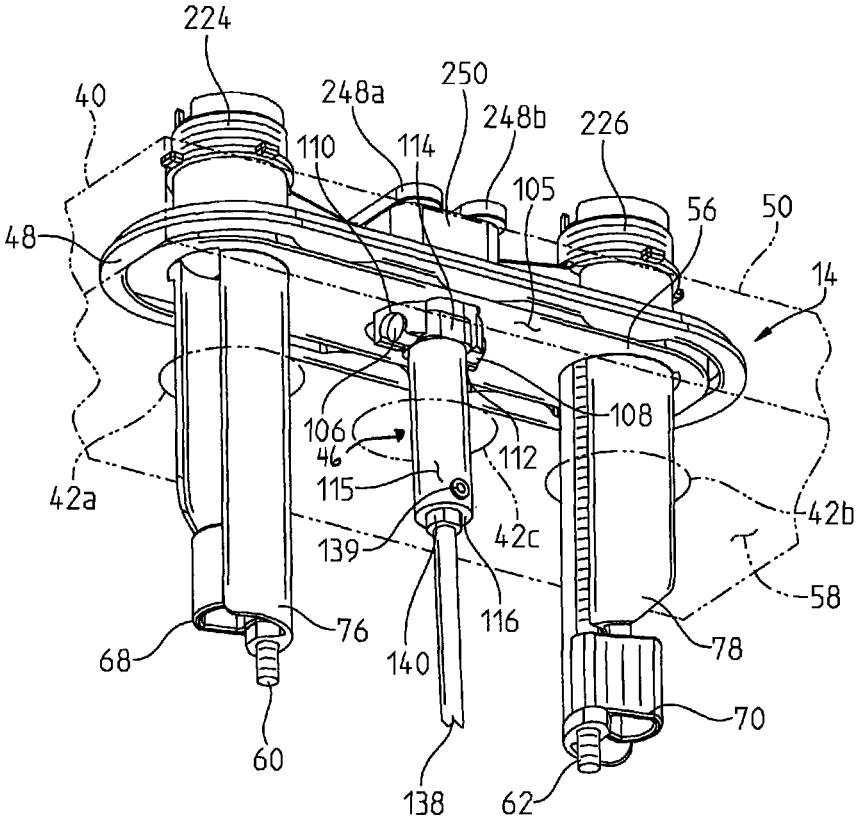
FIG. 8 is a partial bottom perspective view of the faucet assembly of FIG. 7, positioned on a mounting deck.
Figure 9:
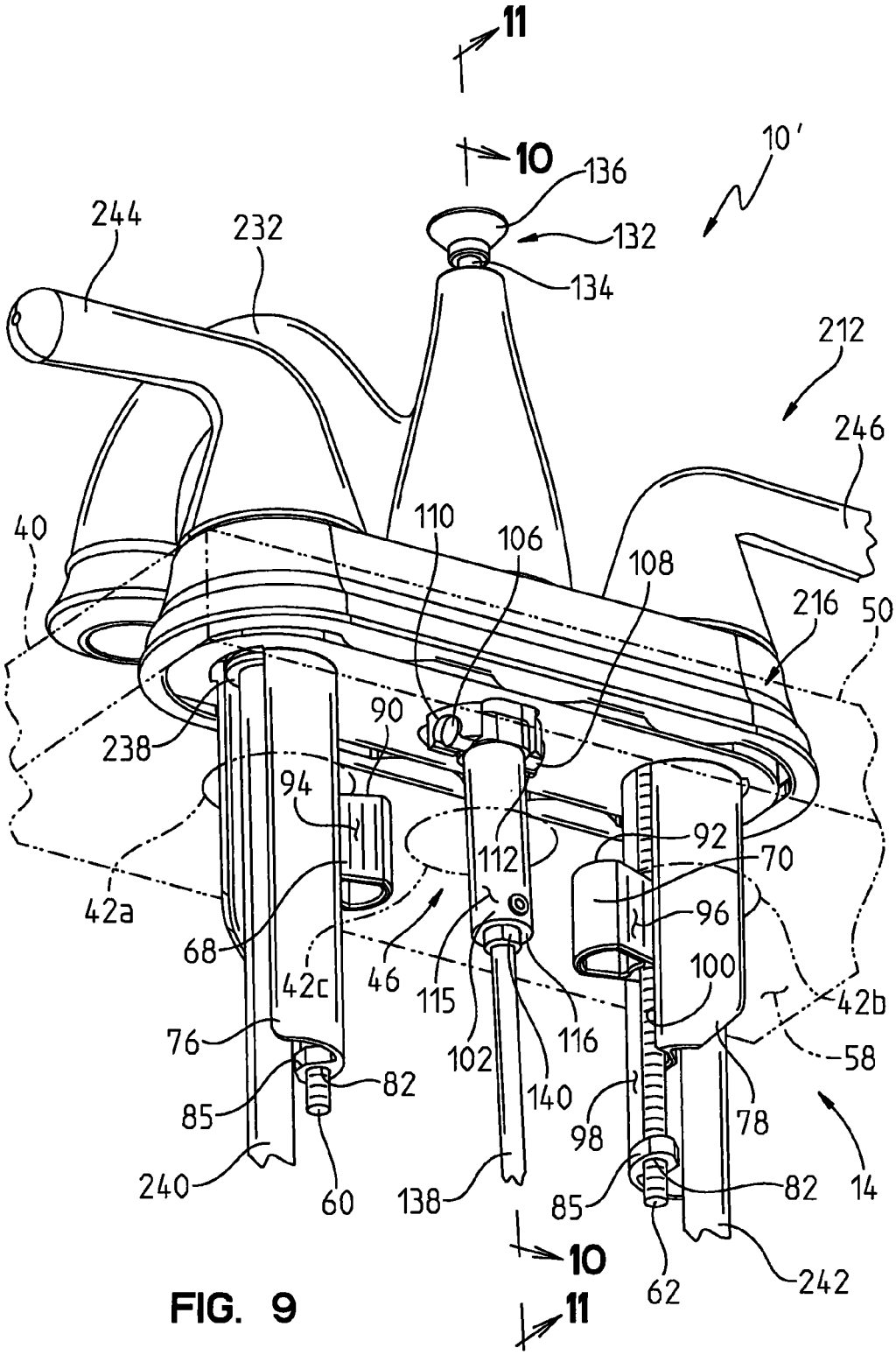
FIG. 9 is a bottom perspective view similar to FIG. 8, showing locking members coupling the faucet assembly to the mounting deck.

As further detailed herein, the lower member 138 is operably coupled to a pop-up drain assembly 141 (FIG. 6). The coupler 140, and hence the upper member 134 and the lower member 138 are supported for sliding axial movement within the lift rod passageway 103. A lower stop is illustratively defined by a set screw 139 received within the side wall 116 of the support 102 and extending into a groove or flat 143 formed within the outer surface of the coupler 140 (FIGS. 5A and 5B). The upper end of the flat 143 terminates at a lip 145. Engagement between the set screw 139 and the lip 145 provides a limit stop for downward movement of the coupler 140. In other words, the set screw 139 and lip 145 prevent the coupler 140 from falling out of the bottom of the support 102.

As may be appreciated, the coupler 46, through its pivot coupling to the mounting base 14, may accommodate different lift rod orientations. For example, the lift rod 132 shown in FIG. 5 has an angle of orientation that may be varied based upon different upper faucet assembly 12 designs. In the illustrative embodiment of FIGS. 5A and 5B, a is substantially equal to 14°. As such, the same mounting base 14 may be used with a variety of different upper faucet assemblies 12 having different lift rod 132 geometries or orientations.

With reference to the illustrative embodiment of FIG. 6, the lift rod 132 is operably coupled to a lever or pivot arm 142 of the pop-up drain assembly 141 through a coupler 144. The pivot arm 142 is configured to pivot about a pivot seat 146 in order to raise and lower a stopper or plug 148 coupled to the pivot arm 142. More particularly, the pivot seat 146 includes a truncated ball 150 supported for pivoting movement about a pivot nut 152 and cooperating pivot base 154. The plug 148 is received within a flange 156 supported by the sink basin 158. The flange 156 is in communication with a tubular drain body 160 which is in fluid communication with a tail piece 162 for coupling to a conventional drain pipe (not shown).

In operation, pulling up on the handle 136 raises the upper member 134. In response, the coupler 140 causes the lower member 138 and, in turn, the coupler 144 and the pivot arm 142 to pivot upwardly in the direction of arrow 164. The pivot arm 142 pivots about the pivot seat 146, thereby causing downward movement of the plug 148 in the direction of arrow 166. Pushing down on the raised handle 136 lowers the upper member 134. In response, the coupler 140 causes the lower member 138 and, in turn, the coupler 144 and the pivot arm 142 to pivot downwardly in the direction of arrow 168. The pivot arm 142 pivots about the pivot seat 146, thereby causing upward movement of the plug 148 in the direction of arrow 170.

To mount the mounting base 14 onto the mounting deck 40, mounting plate locking members 68 and 70 are oriented in retracted positions nested within respective supports 76 and 78 (FIG. 2), and passed through openings 42*a* and 42*b* of the mounting deck 40 from above along with the attachment posts 60 and 62 and supports 76 and 78. Simultaneously, the guide or coupler 46 is passed through opening 42*c* of the mounting deck 40. The attachment posts 60 and 62 are rotated clockwise such that the locking members 68 and 70 rotate to extended positions outside of respective supports 76 and 78 (FIG. 3). Continued clockwise rotation causes the locking members 68 and 70 to move upwardly along the length of the respective post 60 and 62 such that the upper surfaces 92 of the locking members 68 and 70 engage the lower surface 58 of the mounting deck 40, thereby clamping the deck 40 between the locking members 68 and 70 and the mounting plate 56. The installation process continues by passing the fluid end connectors 41 and associated conduits 34 and 36 through the access openings 59*a* and 59*b* formed in the mounting plate 56. The end connectors 41 of the inlet conduits 34 and 36 are then coupled with hot and cold water supplies to provide fluid communication therewith.

Next, the upper faucet assembly 12 is lowered into engagement with the mounting base 14. More particularly, the locking surface 28 is aligned with the support 102 of the coupler 46. The lock bushing 118, supported by the lower securing member 21, is then rotated in a clockwise direction using a tool, such as Allen wrench 129, such that threaded engagement with the support 102 causes the flange 126 of the lock bushing 118 to move into engagement with the locking surface 28 of the upper faucet assembly 12. The upper member 134 of the lift rod 132 may then be inserted into the lift rod passageway 103 of the coupler 46 and secured to the lift rod coupler 140 and, hence, to the drain assembly 141.

With reference now to FIGS. 7-12, a further illustrative embodiment dual handle faucet assembly 10' is shown as including an upper faucet assembly 212 positioned above the mounting base 14. As noted above, different upper faucet assemblies 12 and 212 may be interchangeably received upon the same mounting base 14. As such, in the following description like components will be identified with similar reference numbers.

The upper faucet assembly 212 illustratively includes an escutcheon or body housing 216 receiving a waterway assembly 218 fluidly coupled to a cold water control valve 220 and a hot water control valve 222. More particularly, the waterway includes a first chamber or housing 224 for receiving the cold water control valve 220, and a second chamber or housing 226 for receiving the hot water control valve 222. A conduit 228 extends between the first and second chambers and an outlet 230 which is in fluid communication with a delivery spout 232. A cold water inlet 234 is in fluid communication with the first chamber 224 and cold water control valve 220, while a hot water inlet 236 is in fluid communication with the second chamber 226 and the hot water control valve 222. Conventional fluid couplings 238 may be utilized to connect the respective inlets 234, 236 to cold and hot water sources (not shown) through cold and hot water inlet conduits 240 and 242. Cold and hot water handles 244 and 246 are operably coupled to control valves 220 and 222, respectively, to control the flow rate and temperature of water delivered from the inlet conduits 240 and 242 to the delivery spout 232.

Figure 10:
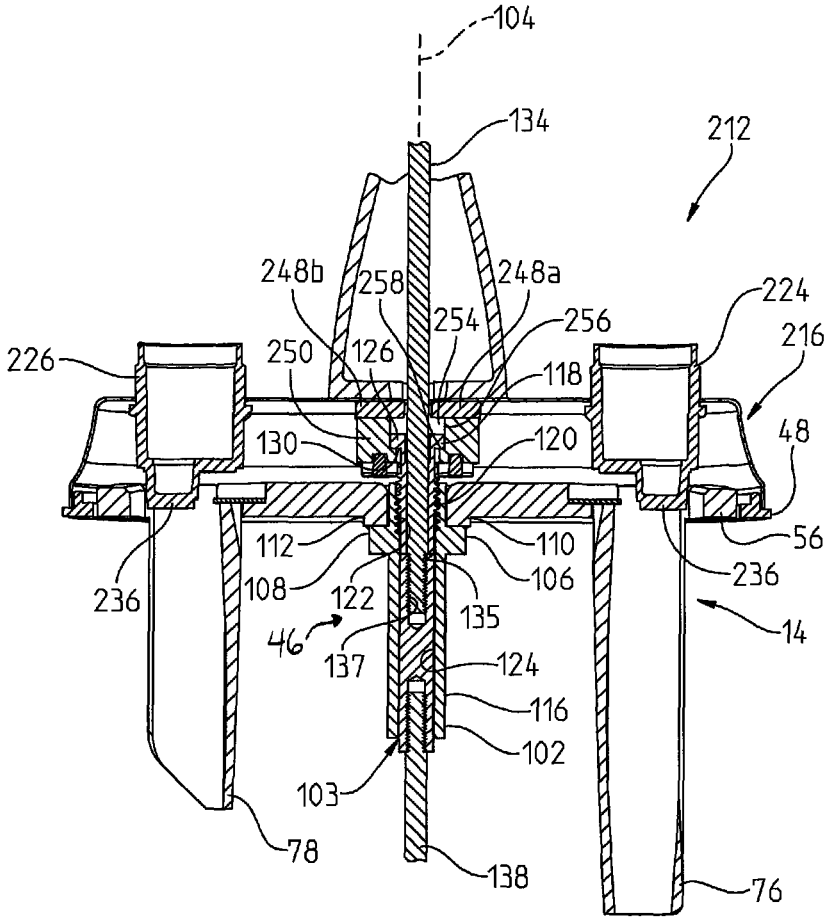
FIG. 10 is cross-sectional view taken along line 10-10 of FIG. 9.

A pair of tabs 248*a*, 248*b* extend outwardly from the waterway 218 and are coupled to an attachment block 250 by a pair of fasteners 252*a*, 252*b*. The fasteners 252*a*, 252*b* couple to block 250 and tabs 248 to the escutcheon 216. The attachment block 250 includes a through hole 254 and a counterbore 256 defining an engagement or locking surface 258 (FIG. 10). The lock bushing 118 extends through the hole 254 in the attachment block 250, wherein the lower surface 130 of the flange 126 is configured to engage the locking surface 258. Once the upper faucet assembly 212 is fully assembled, the flange 126 is captured within the attachment block 250 by the tabs 248 (FIG. 10).

With reference now to FIGS. 3, 5A, 9, and 11A, the upper faucet assembly 12 (FIG. 3) may be interchanged with the upper faucet assembly 212 (FIG. 9) without modifying the mounting base 14. More particularly, the first upper faucet assembly 12 is coupled to the mounting base in the manner detailed above by rotating the lock bushing 118 within the support 102 of the coupler 46 such that the flange 126 engages the locking surface 28 (FIG. 5B). The lift rod passageway 103 slidably receives the lift rod 132 at a first angular orientation $\alpha$ within a plane extending perpendicular to the mounting deck 40. As shown in FIG. 5A, this angular orientation $\alpha$ is substantially equal to 14°. The upper faucet assembly 12 may be removed from the mounting base 14 removing the upper member 134 of the lift rod 132, by unthreading the lock bushing 118 from the support 102 of the coupler 46, and lifting the upper faucet assembly 12 away from the mounting base 14 (FIG. 5B). The end connectors 41 are also uncoupled from their respective water supplies.

Figure 11A:
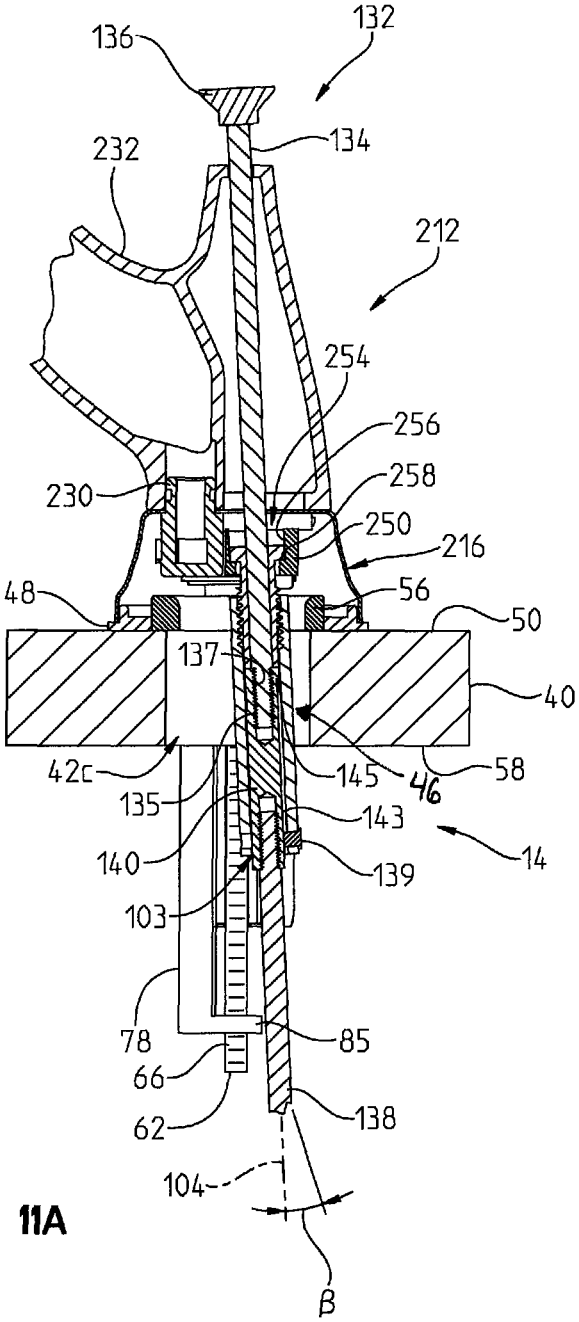
FIG. 11A is a cross-sectional view taken along line 11-11 of FIG. 9.
Figure 11B:
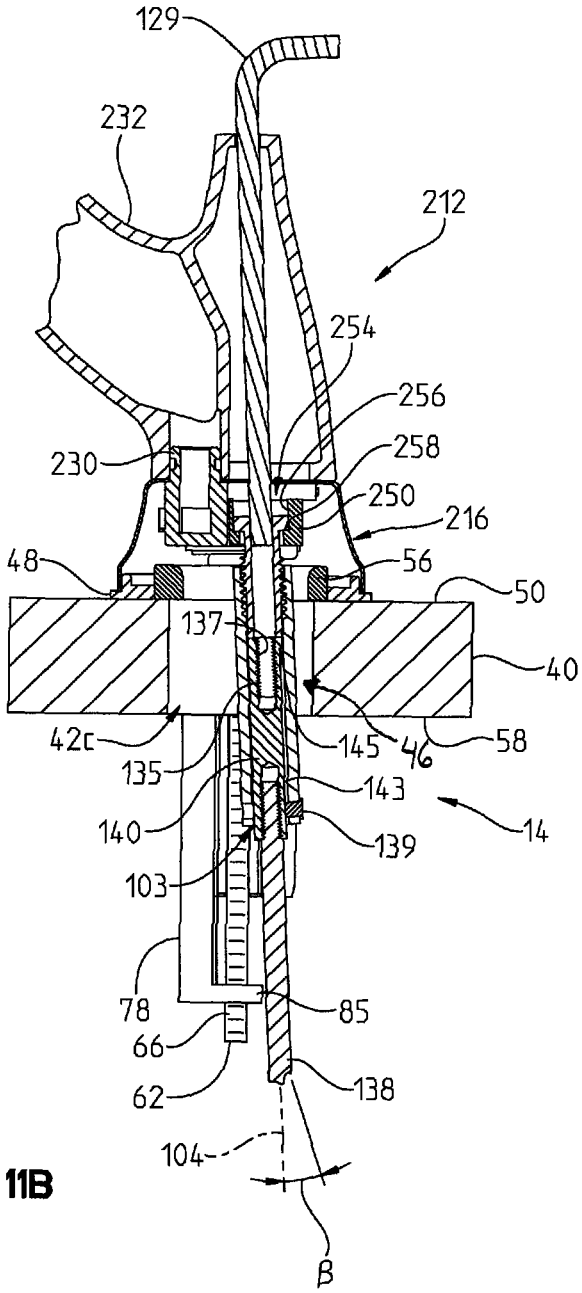
FIG. 11B is a cross-sectional view similar to FIG. 11A, with the upper member of the lift rod removed and replaced with a tool.
Figure 12:
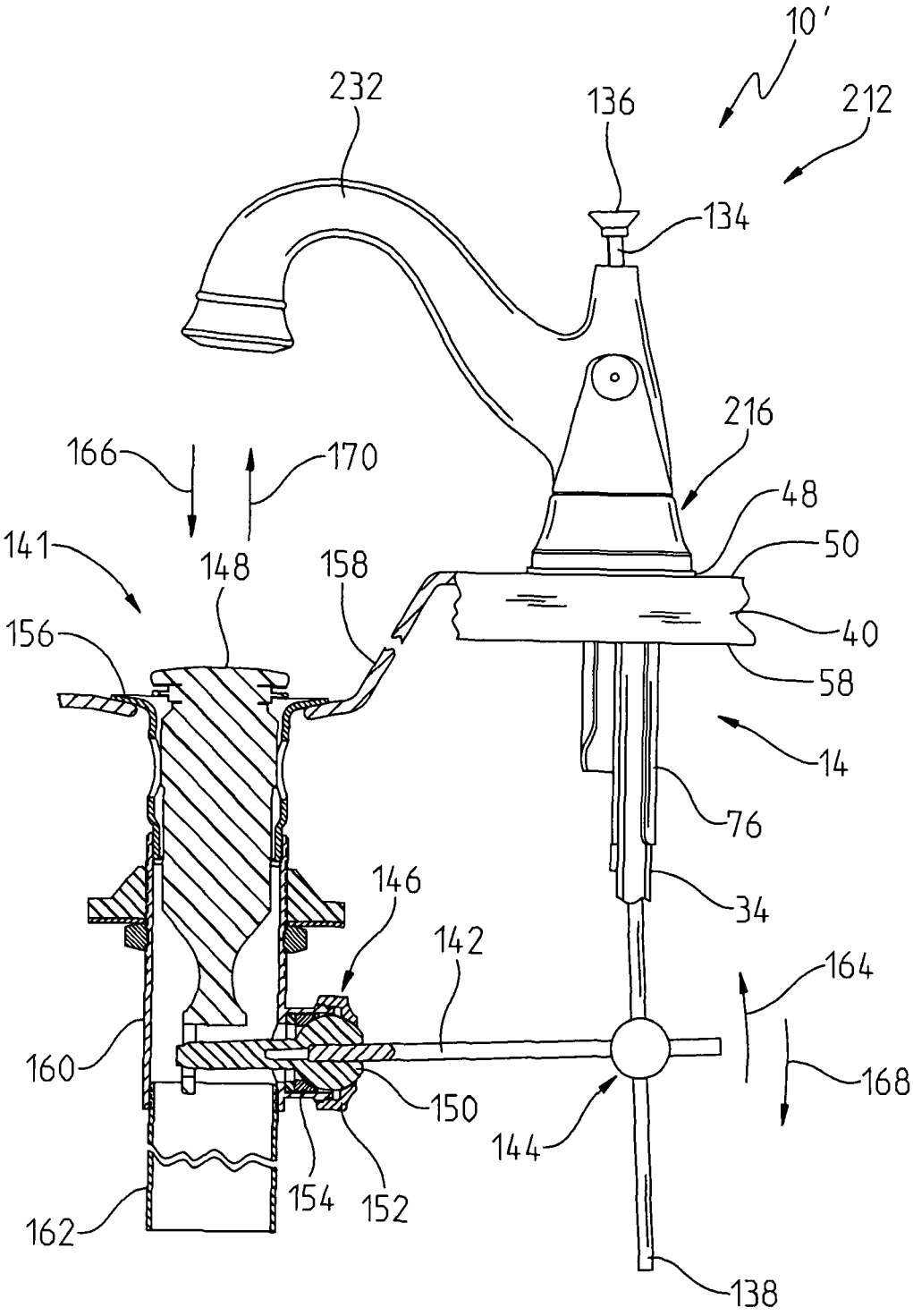
FIG. 12 is a side elevational view, in partial cross-section, illustrating the faucet assembly of FIG. 7 coupled to a pop-up drain assembly.

Next, the upper faucet assembly 212 may be placed on top of the mounting base 14. The lock bushing 118 is then threaded into the support 102 of the coupler 46 such that the flange 126 engages the locking surface 258 (FIG. 11B). The upper member 134 of the lift rod 132 is inserted within the coupler 140 and threadably coupled thereto. The lift rod passageway 103 receives the lift rod 132 at a second angular orientation $\beta$ within a plane extending perpendicular to the mounting deck 40. As shown in FIG. 11A, this angular orientation $\beta$ is substantially equal to 2.75°.

The pivoting support of the coupler 46 provides for different angular orientations of the lift rod 132 associated with the upper faucet assembly 12 as compared to the lift rod 132 of the upper faucet assembly 212. More particularly, the lift rod 132 of upper faucet assembly 12 is positioned at the first angular orientation $\alpha$, while the lift rod of the upper faucet assembly 212 is positioned at the second angular orientation $\beta$.

Although the invention has been described in detail with reference to certain preferred embodiments, variations and modifications exist within the spirit and scope of the invention as described and defined in the following claims.

The invention claimed is:

1. A faucet assembly comprising:

a delivery spout;

at least one valve fluidly coupled to the delivery spout and configured to control the flow of water to the delivery spout;

a lift rod supported for movement relative to the delivery spout; and a pivoting tubular guide including a lift rod passageway slidably receiving the lift rod and defining a longitudinal axis, the guide supported for pivoting movement about a transverse axis extending perpendicular to the longitudinal axis to support the lift rod at one of a plurality of angular orientations.

2. The faucet assembly of claim 1, further comprising:

a mounting base supporting the delivery spout; and wherein the guide includes a support member pivotally coupled to the mounting base, and a securing member coupled to an upper end of the support member, the securing member being configured to releasably secure the delivery spout to the mounting base.

3. The faucet assembly of claim 2, wherein the guide further includes at least one pivot pin, and the mounting base includes at least one socket rotatably receiving the at least one pivot pin.

4. The faucet assembly of claim 2, wherein the upper end of the securing member includes a tool engaging surface.

5. The faucet assembly of claim 2, wherein the mounting base includes:

a base plate;

a first attachment post extending downwardly from the base plate;

a second attachment post extending downwardly from the base plate;

a first mounting base locking member operably coupled to the first attachment post, wherein the first mounting base is movable along the first attachment post for engaging the under surface of the mounting deck; and a second mounting base locking member operably coupled to the second attachment post; wherein the first mounting base is movable along the first attachment post for engaging the under surface of the mounting deck.

6. The faucet assembly of claim 1, further comprising a drain assembly including a drain plug operably coupled to the lift rod such that movement of the lift rod causes corresponding movement of the drain plug.

7. A faucet assembly comprising:

a mounting base configured to be coupled to a mounting deck;

an upper faucet assembly positioned above the mounting base, the upper faucet assembly including a delivery spout and a locking surface; and a coupler including a pivoting support member pivotally supported by the mounting base, the support member positionable in a plurality of angular orientations, and a securing member connected to the support member and releasably engaging the locking surface of the upper faucet assembly for releasably securing the upper faucet assembly to the mounting base.

8. The faucet assembly of claim 7, wherein the securing member comprises a lock bushing threadably coupled to the support member, the lock bushing including an annular flange for engaging the locking surface of the upper faucet assembly.

9. The faucet assembly of claim 8, wherein the upper end of the lock bushing includes a tool engaging surface.

10. The faucet assembly of claim 7, further comprising a lift rod, wherein the coupler includes a lift rod passageway slidably receiving the lift rod and defining a longitudinal axis, the coupler being supported for pivoting movement about a transverse axis extending perpendicular to the longitudinal axis.

11. The faucet assembly of claim 10, further comprising a drain assembly including a drain plug operably coupled to the lift rod such that movement of the lift rod causes corresponding movement of the drain plug.

12. The faucet assembly of claim 7, wherein the coupler further includes at least one pivot pin, and the mounting base includes at least one socket rotatably receiving the pivot pin.

13. The faucet assembly of claim 7, wherein the mounting base includes:

a base plate;

a first attachment post extending downwardly from the base plate;

a second attachment post extending downwardly from the base plate;

a first mounting base locking member operably coupled to the first attachment post, wherein the first mounting base is movable along the first attachment post for engaging the under surface of the mounting deck; and a second mounting base locking member operably coupled to the second attachment post; wherein the first mounting base is movable along the first attachment post for engaging the under surface of the mounting deck.

14. A coupling system for use with a faucet assembly including a lift rod, the coupling system comprising:

a mounting base configured to be coupled to a mounting deck; and a coupler including a pivoting support member and a securing member movably connected to the support member, the support member defining a lift rod passageway configured to slidably receive a lift rod and defining a longitudinal axis, the support member being supported by the mounting base for pivoting movement about a transverse axis extending perpendicular to the longitudinal axis to support the lift rod at one of a plurality of angular orientations.

15. The coupling system of claim 14, wherein the support member further includes at least one pivot pin, and the mounting base includes at least one socket rotatably receiving the at least one pivot pin.

16. The coupling system of claim 14, wherein the securing member comprises a lock bushing threadably coupled to the support member, the lock bushing including an annular flange for clamping a locking surface to the mounting base.

17. The coupling system of claim 16, wherein the support member includes a nut cooperating with the flange of the lock bushing for clamping an upper faucet assembly to the mounting base.

18. The coupling system of claim 14, wherein the mounting base includes:

a base plate;

a first attachment post extending downwardly from the base plate;

a second attachment post extending downwardly from the base plate;

a first mounting base locking member operably coupled to the first attachment post, wherein the first mounting base is movable along the first attachment post for engaging the under surface of the mounting deck; and a second mounting base locking member operably coupled to the second attachment post; wherein the first mounting base is movable along the first attachment post for engaging the under surface of the mounting deck.

19. A faucet system kit including:

a mounting base configured to be coupled to a mounting deck and supporting a lift rod passageway;

a first upper faucet assembly including a delivery spout, and a single handle coupled to a control valve to control the flow of water to the delivery spout;

a second upper faucet assembly including a delivery spout, a first handle coupled to a first control valve to control the flow of hot water to the delivery spout, and a second handle coupled to a second control valve to control the flow of cold water to the delivery spout;

a lift rod having a longitudinal axis and slidably received within the lift rod passageway; and wherein the first upper faucet assembly and the second upper faucet assembly are configured to be interchangeably mounted on the mounting base with the lift rod extending through the lift rod passageway, the lift rod passageway supporting the lift rod at one of a plurality of angular orientations, the longitudinal axis of the lift rod having a first angular orientation when the first upper faucet assembly is mounted on the mounting base and having a second angular orientation when the second upper faucet assembly is mounted on the mounting base, the first angular orientation being different from the second angular orientation.

20. The faucet system kit of claim 19, further comprising a guide supported by the mounting base and defining the lift rod passageway, wherein the guide is supported for pivoting movement about a transverse axis extending perpendicular to the longitudinal axis of the lift rod.

21. The faucet system kit of claim 20, wherein the guide includes a support member pivotally coupled to the mounting base, and a securing member threadably coupled to an upper end of the support member, the securing member being configured to releasably secure alternately the first upper faucet assembly and the second upper faucet assembly to the mounting base.

22. The faucet system kit of claim 21, wherein the guide member further includes at least one pivot pin, and the mounting base includes at least one socket rotatably receiving the at least one pivot pin.

23. The faucet system kit of claim 19, further comprising a drain assembly including a drain plug operably coupled to the lift rod such that movement of the lift rod causes corresponding movement of the drain plug.

* * * * *